US008182068B2

(12) United States Patent
Panchawagh et al.

(10) Patent No.: US 8,182,068 B2
(45) Date of Patent: May 22, 2012

(54) PRINTHEAD INCLUDING DUAL NOZZLE STRUCTURE

(75) Inventors: Hrishikesh V. Panchawagh, Rochester, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 383 days.

(21) Appl. No.: 12/511,138

(22) Filed: Jul. 29, 2009

(65) Prior Publication Data

US 2011/0025779 A1 Feb. 3, 2011

(51) Int. Cl.
*B41J 2/14* (2006.01)
*B41J 2/16* (2006.01)

(52) U.S. Cl. ..... 347/47; 347/44; 347/76; 347/77

(58) Field of Classification Search ..... 347/20, 347/40, 42, 43, 47–49, 59, 61–71, 73, 75–76
See application file for complete search history.

(56) References Cited

U.S. PATENT DOCUMENTS

| | | | | |
|---|---|---|---|---|
| 6,079,821 | A | 6/2000 | Chwalek et al. | |
| 6,439,703 | B1 | 8/2002 | Anagnostopoulos et al. | |
| 6,450,619 | B1 | 9/2002 | Anagnostopoulos et al. | |
| 6,457,807 | B1 | 10/2002 | Hawkins et al. | |
| 6,491,362 | B1 | 12/2002 | Jeanmaire | |
| 6,505,918 | B1 * | 1/2003 | Condie et al. | 347/69 |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,663,221 | B2 | 12/2003 | Anagnostopoulos et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,086,142 | B2 | 8/2006 | Kim et al. | |
| 7,104,633 | B2 | 9/2006 | Kim et al. | |
| 7,766,462 | B2 * | 8/2010 | Haluzak et al. | 347/71 |
| 7,806,517 | B2 * | 10/2010 | Muraoka | 347/65 |

* cited by examiner

*Primary Examiner* — Thinh Nguyen
(74) *Attorney, Agent, or Firm* — William R. Zimmerli

(57) ABSTRACT

A printhead includes a first nozzle bore, a liquid chamber, and a second nozzle bore. The liquid chamber is positioned between the first nozzle bore and the second nozzle bore and extends beyond the opening of the first nozzle bore. The first nozzle bore is in liquid communication with the second nozzle bore through the liquid chamber.

18 Claims, 12 Drawing Sheets

SECTION A-A

PRINTHEAD INCLUDING DUAL NOZZLE STRUCTURE

CROSS REFERENCE TO RELATED APPLICATIONS

Reference is made to commonly-assigned, U.S. patent application Ser. No. 12/511,147, entitled "PRINTHEAD HAVING REINFORCED NOZZLE MEMBRANE STRUCTURE" filed concurrently herewith.

FIELD OF THE INVENTION

This invention relates generally to the field of digitally controlled printing systems, and in particular to the printheads of these types of printing systems.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Drop on demand printing only provides drops (often referred to a "print drops") for impact upon a print media. Selective activation of an actuator causes the formation and ejection of a drop from a printhead that strikes the print media. The formation of printed images is achieved by controlling the individual formation of drops. Typically, one of two types of actuators is used in drop on demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled.

Continuous inkjet printing uses a pressurized liquid source connected in fluid communication to a printhead to eject liquid jets from the printhead. Streams of drops are formed from the liquid jets. Some of these drops are selected to contact a print media (often referred to a "print drops") while others are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

As the printing industry continues to develop these types of printing systems, aspects of these printing systems are refined in order to maintain various characteristics. For example, as longer printheads (often referred to as pagewide printheads) are developed, printhead components can be refined in order to maintain manufacturing costs at reasonable levels. Nozzle plates, for example, can be thinned or otherwise reduced in thickness while channels that, for example, supply liquid to the nozzles are lengthened or otherwise increased in size. As a result, these printheads tend to be structurally weak so that if the printhead is subjected to mechanical stresses, for example, during packaging or operation, the printhead might sufficiently fatigue and prematurely fail. Throughout this process, there is a desire to maintain printhead characteristics that help to provide acceptable image quality levels during printhead operation.

As such, there is an ongoing effort to improve the structural integrity of printheads while maintaining printhead characteristics that help to provide acceptable image quality levels during printhead operation.

SUMMARY OF THE INVENTION

According to one feature of the present invention, a printhead includes a first nozzle bore, a liquid chamber, and a second nozzle bore. The liquid chamber is positioned between the first nozzle bore and the second nozzle bore and extends beyond the opening of the first nozzle bore. The first nozzle bore is in liquid communication with the second nozzle bore through the liquid chamber.

According to another feature of the present invention, a printhead includes a jetting module including a plurality of nozzle structures. Each nozzle structure includes a first nozzle bore, a liquid chamber, and a second nozzle bore. The liquid chamber is positioned between the first nozzle bore and the second nozzle bore and extends beyond the opening of the first nozzle bore. The first nozzle bore is in liquid communication with the second nozzle bore through the liquid chamber.

According to another feature of the present invention, a method of printing includes providing a printhead including a jetting module including a plurality of nozzle structures, each nozzle structure including a first nozzle bore, a liquid chamber, and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber; and a drop forming mechanism associated with the jetting module; providing a liquid under pressure sufficient to eject jets of the liquid through the plurality of nozzle structures; and actuating the drop forming mechanism to form drops from the jets of liquid.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
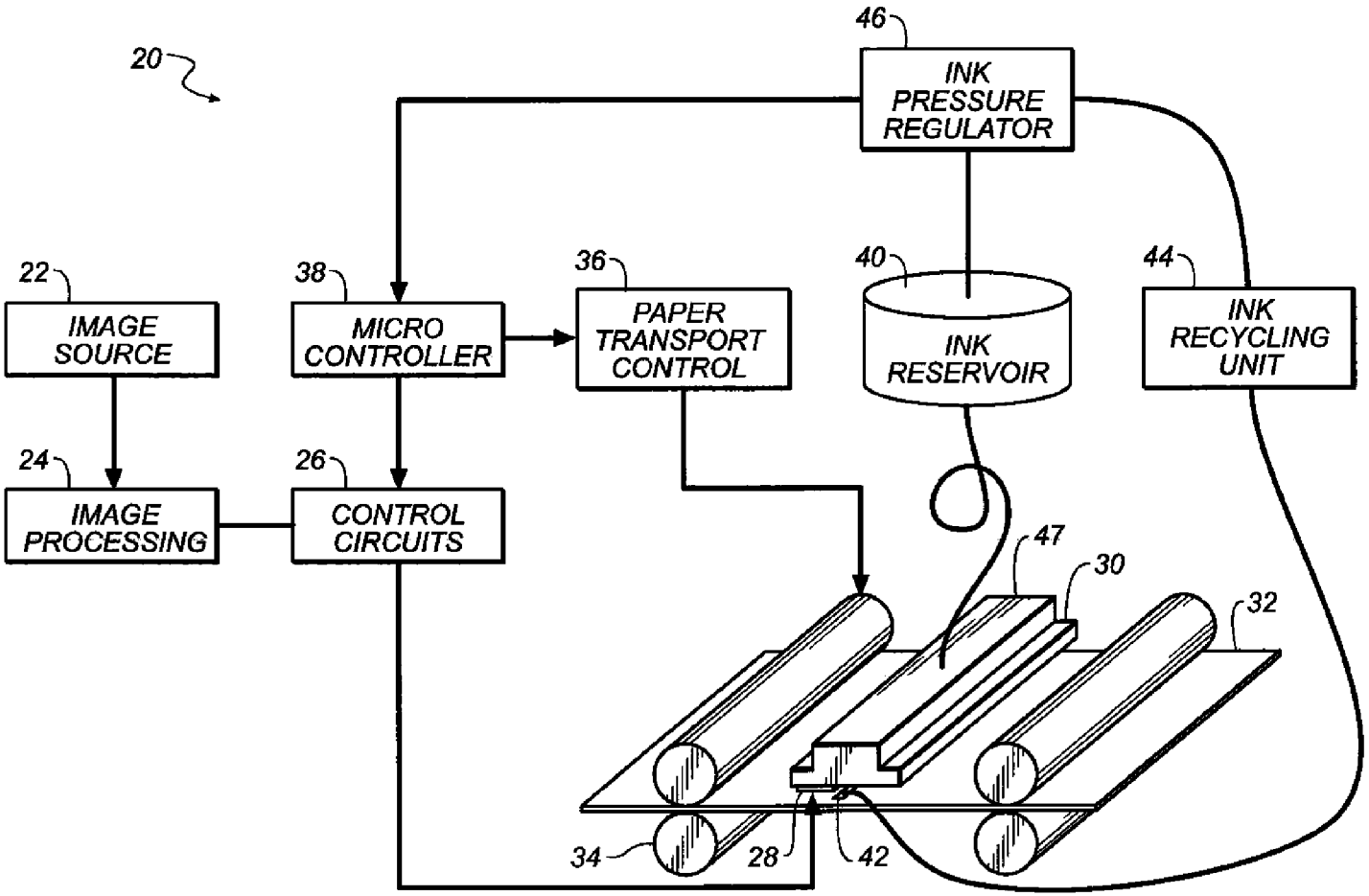
FIG. 1 is a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described can take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which can allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
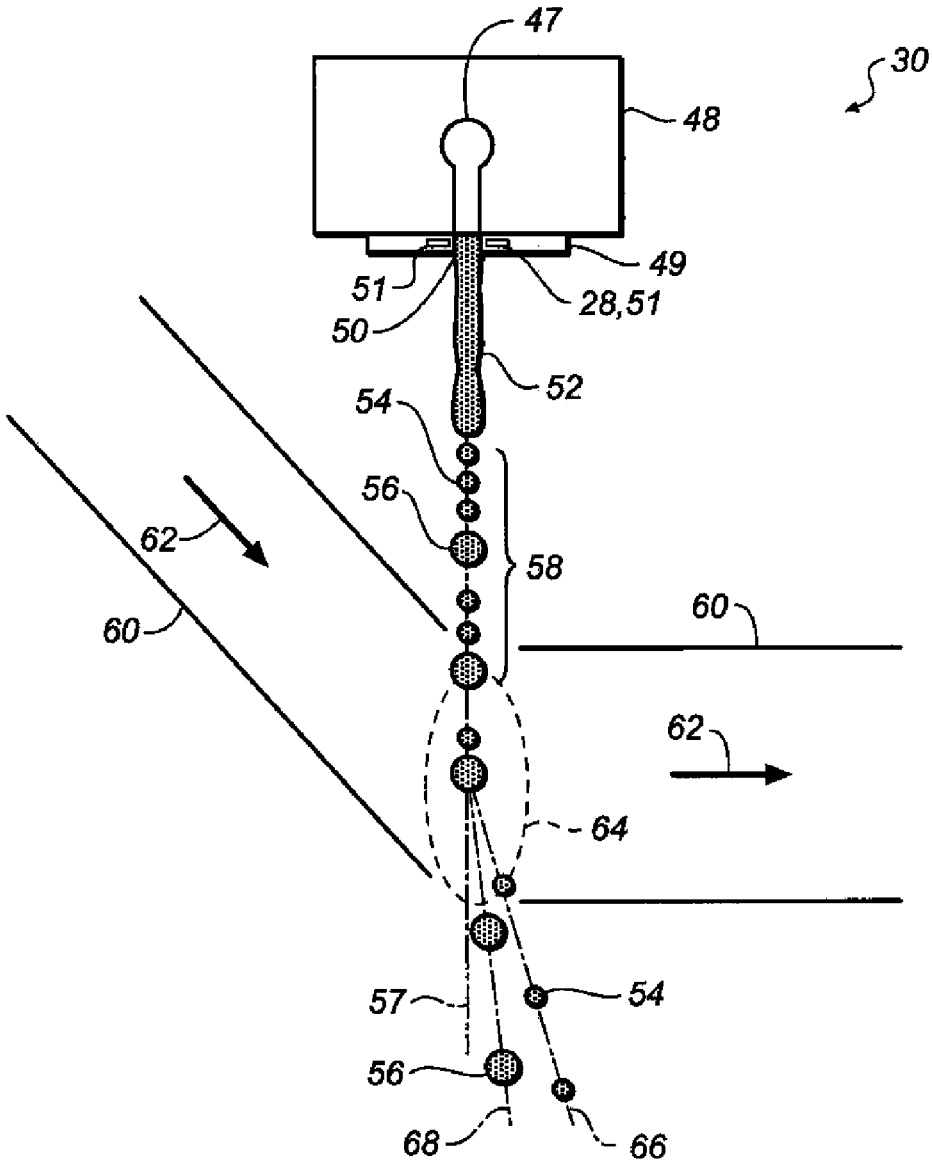
FIG. 2 is a schematic view of an example embodiment of a printhead made in accordance with the present invention.
Figure 3:
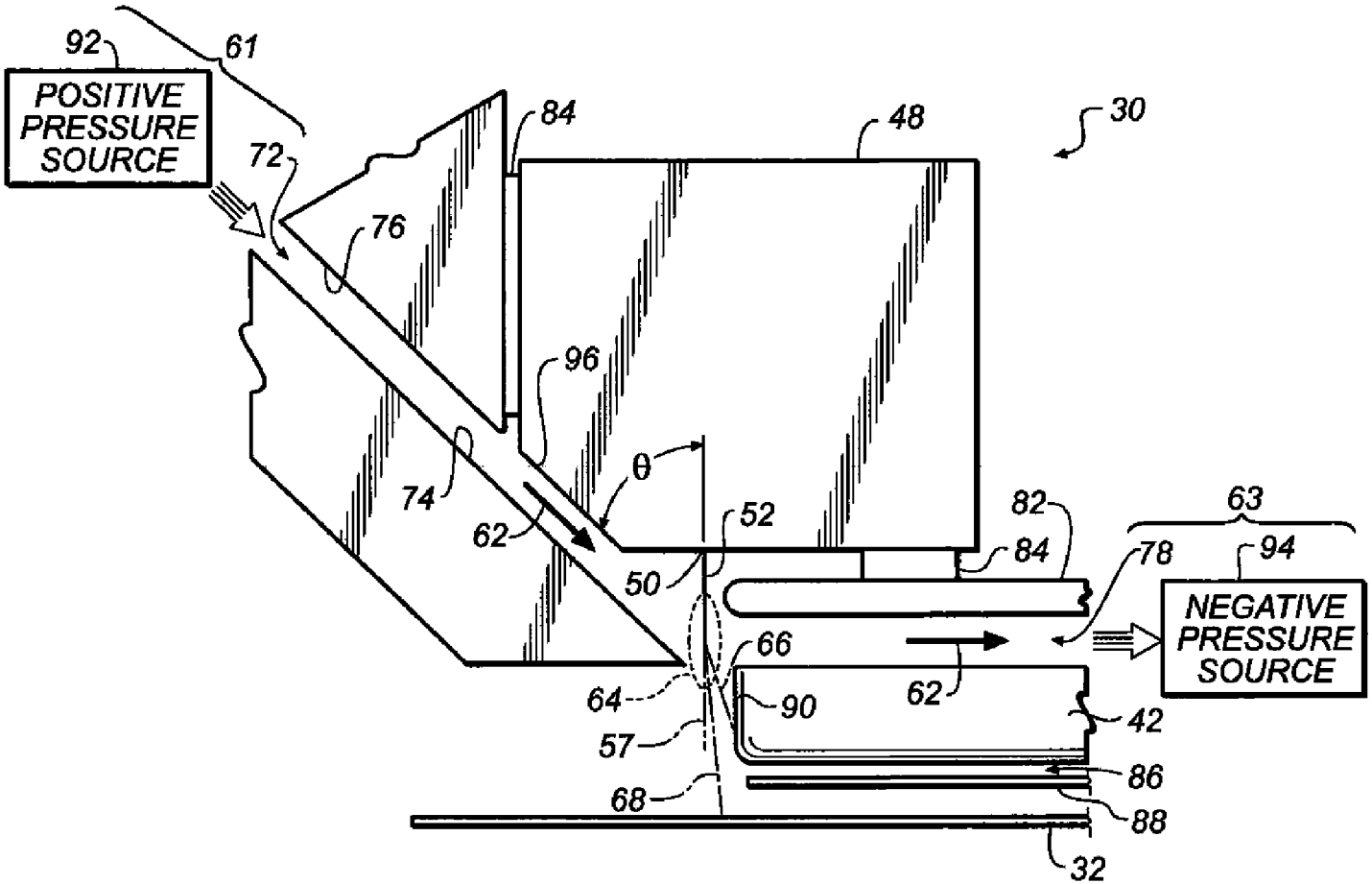
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in one or more of the following: U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No.

6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Conventional electrostatic deflection can also be used to accomplish drop deflection.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
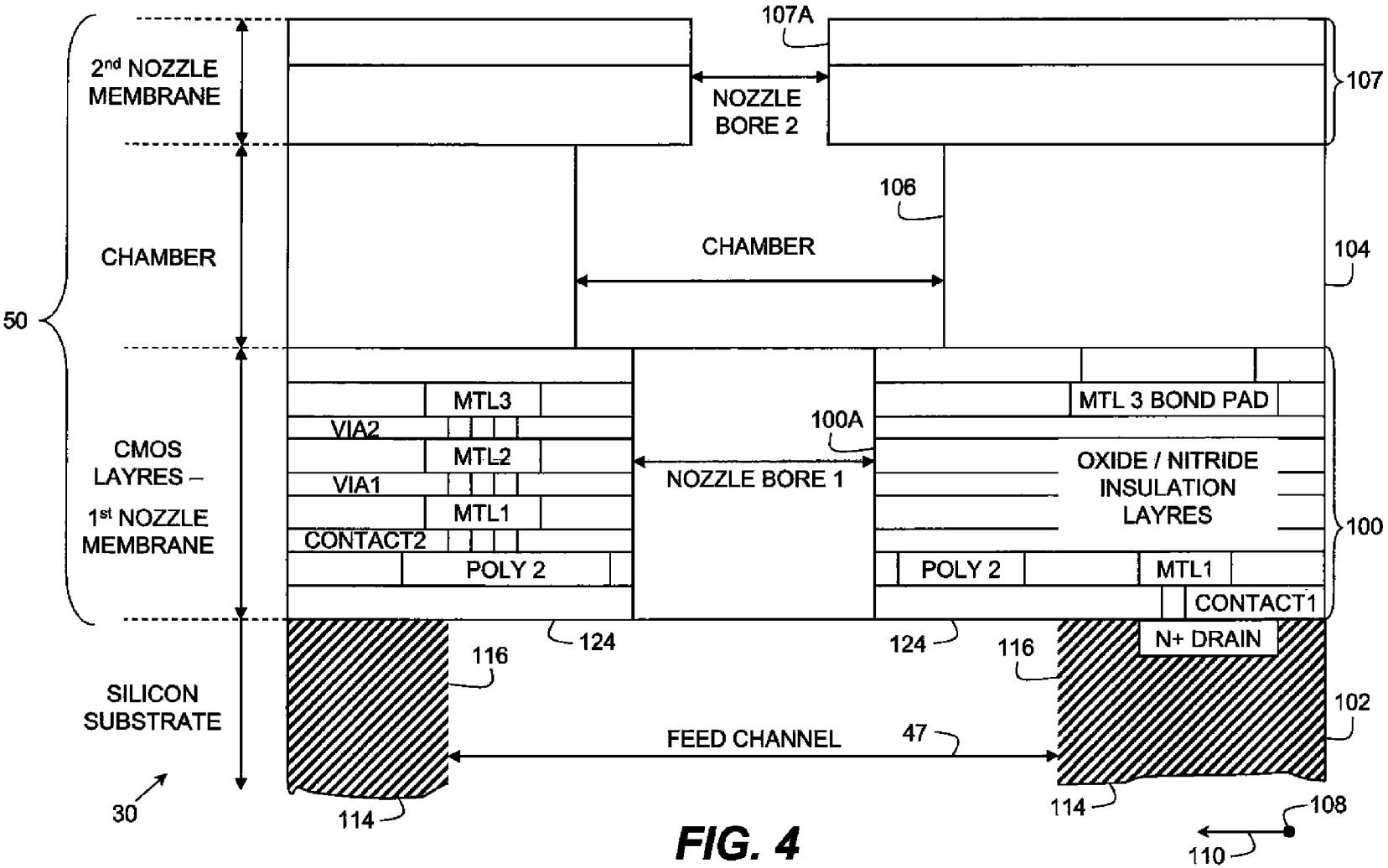
FIG. 4 shows a schematic cross sectional view of an example embodiment of a printhead made in accordance with the present invention.
Figure 5:
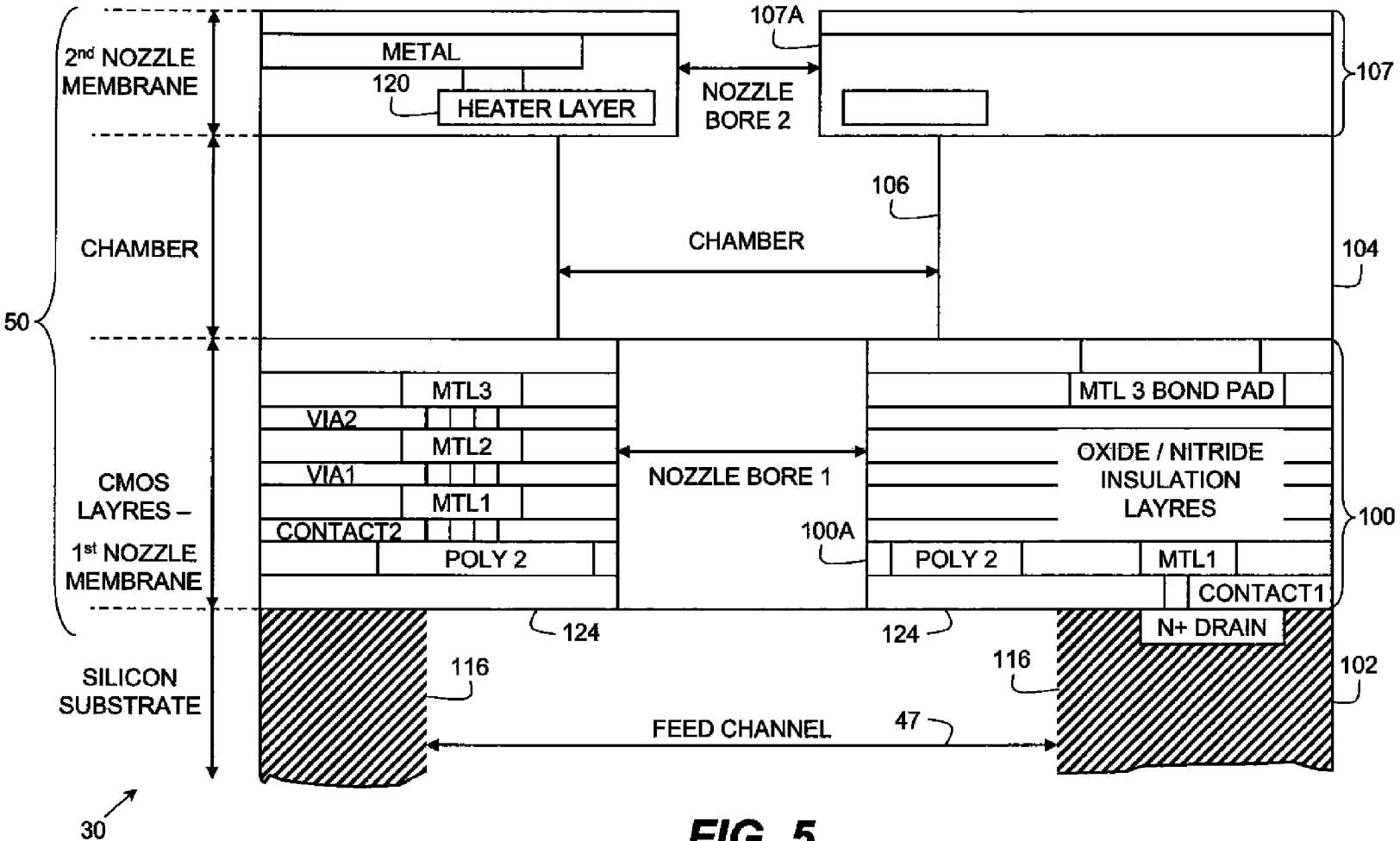
FIG. 5 is a schematic cross sectional view of another example embodiment of a printhead made in accordance with the present invention.

Referring to FIGS. 4 and 5, example embodiments of a printhead 30 made in accordance with the present invention are shown. A jetting module 48 of printhead 30 includes a first nozzle membrane 100, a substrate 102, a support structure 104 that forms a liquid chamber 106, and a second nozzle membrane 107. Portions of first nozzle membrane 100 and second nozzle membrane 107 define a first nozzle bore 100A and a second nozzle bore 107A, respectively. In addition to providing liquid chamber 106, support structure 104, affixed to first nozzle membrane 100, provides structural support to first nozzle membrane 100.

The liquid chamber 106 is positioned between the first nozzle bore 100A and the second nozzle bore 107A and extends beyond the opening of the first nozzle bore such that the liquid chamber 106 is wider than the opening of the first nozzle bore 100A when viewed from a plane that is parallel to a cross sectional view of the jetting module 48 (the view shown in FIGS. 4 and 5). Liquid chamber 106 also extends beyond the opening of the second nozzle bore such that the liquid chamber 106 is wider than the opening of the second nozzle bore 107A when viewed from a plane that is parallel to a cross sectional view of the jetting module 48. The first nozzle bore 100A is in liquid communication with the second nozzle bore 107A through the liquid chamber 106. First nozzle bore 100A, liquid chamber 106, and second nozzle bore 107A are typically referred to as a nozzle structure 50 and located in what is referred to as the nozzle plate 112 of jetting module 48. Nozzle structure 50 helps improve jet straightness when compared to devices that don't include nozzle structure 50 because the second nozzle membrane 107 can be fabricated with custom materials, compared to the standard CMOS multi-stack layer that makes up first nozzle membrane 100. This is advantageous for creating a uniform flat surface and a well defined nozzle bore for better jetting performance. Also, when a structural support layer 104 is added between first nozzle membrane 100 and second nozzle membrane 107, ink build up in the chamber opening 106 around nozzle bore 100A interacts with the jet potentially causing ink jet misdirection. Providing second nozzle membrane 107 reduces the likelihood of this happening by creating a well-defined nozzle bore 107A. The chamber 106 is designed to be larger compared to the first nozzle bore 100A for efficient transfer of thermal energy from the heater to the fluid.

The opening of the first nozzle bore 100A and the opening of the second nozzle bore 107A are not equivalent. Typically, the opening of the second nozzle bore 107A is smaller than the opening of the first nozzle bore 100A. This reduces the total pressure drop across the printhead and therefore the pressure required for jetting. This type of nozzle geometry 50 also creates a converging flow which helps in jet straightness and also reduces issues due to possible misalignments between 100A and 107A during manufacturing that could cause jet misdirection. Another advantage of this design is the ability to optimize heater geometry for a more effective stimulation because the heater geometry and the jet size and liquid velocity can be designed independently compared to a design where support layer 104 and second nozzle membrane 107 are absent.

Substrate 102 includes a liquid feed channel 47 that provides liquid to the plurality of nozzle structures 50. Liquid feed channel 47 extends along the length 108 of the nozzle plate 112 such that liquid feed channel 47 is common to each nozzle structure 50 of the plurality of nozzle structures 50. Including a liquid feed channel that is common to nozzle structures 50 helps to reduce the likelihood of drop misdirection caused by, for example, misdirected liquid jets. Portions 114 of substrate 102 form walls 116 that help to define the liquid feed channel 47. Substrate 102 is a silicon substrate. First nozzle membrane 100 includes integrated CMOS circuitry fabricated on substrate 102 using, for example, a CMOS process that includes a standard 0.5 micrometers mixed signal process incorporating two levels of polysilicon and three levels of metal. In FIGS. 4 and 5, this process is represented by the three layers of metal (MTL 1, MTL 2, and MTL 3) shown interconnected with vias (VIA 1 and VIA 2). Also, polysilicon level 2 and an N+ diffusion and contact to metal layer 1 are drawn to indicate active drive circuitry in the silicon substrate 102. Gate electrodes for the CMOS transistor devices are formed from one of the polysilicon layers (POLY 1, POLY 2). Because of the need to electrically insulate the metal layers, dielectric layers are deposited between them typically making the total thickness of the nozzle membrane 100 on silicon substrate 102 about 4.5 micrometers.

The CMOS process also provides a layer of polysilicon (POLY 1, POLY 2) as a stimulation device, for example, a heater element for heating liquid in each nozzle structure 50. During fabrication, a recess (not shown) over first nozzle bore 100A can be etched at the same time as the oxide/nitride film over the bond pads are etched while the bores are photolithographically defined and etched subsequently, since such steps are compatible with VLSI CMOS processing.

As a result of the conventional CMOS fabrication steps a silicon substrate of approximately 675 micrometers in thickness and about 6 inches in diameter is provided. Larger or smaller diameter silicon wafers can be used equally as well. A plurality of transistors are formed in the silicon substrate through conventional steps of selectively depositing various materials to form these transistors as is well known in the industry. Supported on the silicon substrate are a series of layers eventually forming an oxide/nitride insulating layer that has one or more layers of polysilicon and metal layers formed therein in accordance with desired pattern. Vias are provided between various layers as needed and to the bond pads. The various bond pads are provided to make respective connections of data, latch clock, enable clocks, and power provided from a circuit board mounted adjacent the printhead or from a remote location. Although only one of the bond pads is shown it will be understood that multiple bond pads are formed in the nozzle array. The first nozzle membrane 100 shown in FIGS. 4 and 5 typically provides the drive circuitry, for example, the interconnects, transistors and logic gates for controlling printhead operation as well as the first nozzle bore 100A above the silicon substrate 102. This drive circuitry is in electrical communication with the stimulation device. The embedded heater element effectively surrounds each nozzle bore and is proximate to the nozzle bore which reduces the temperature requirement of the heater for heating ink drops in the bore.

Figure 6:
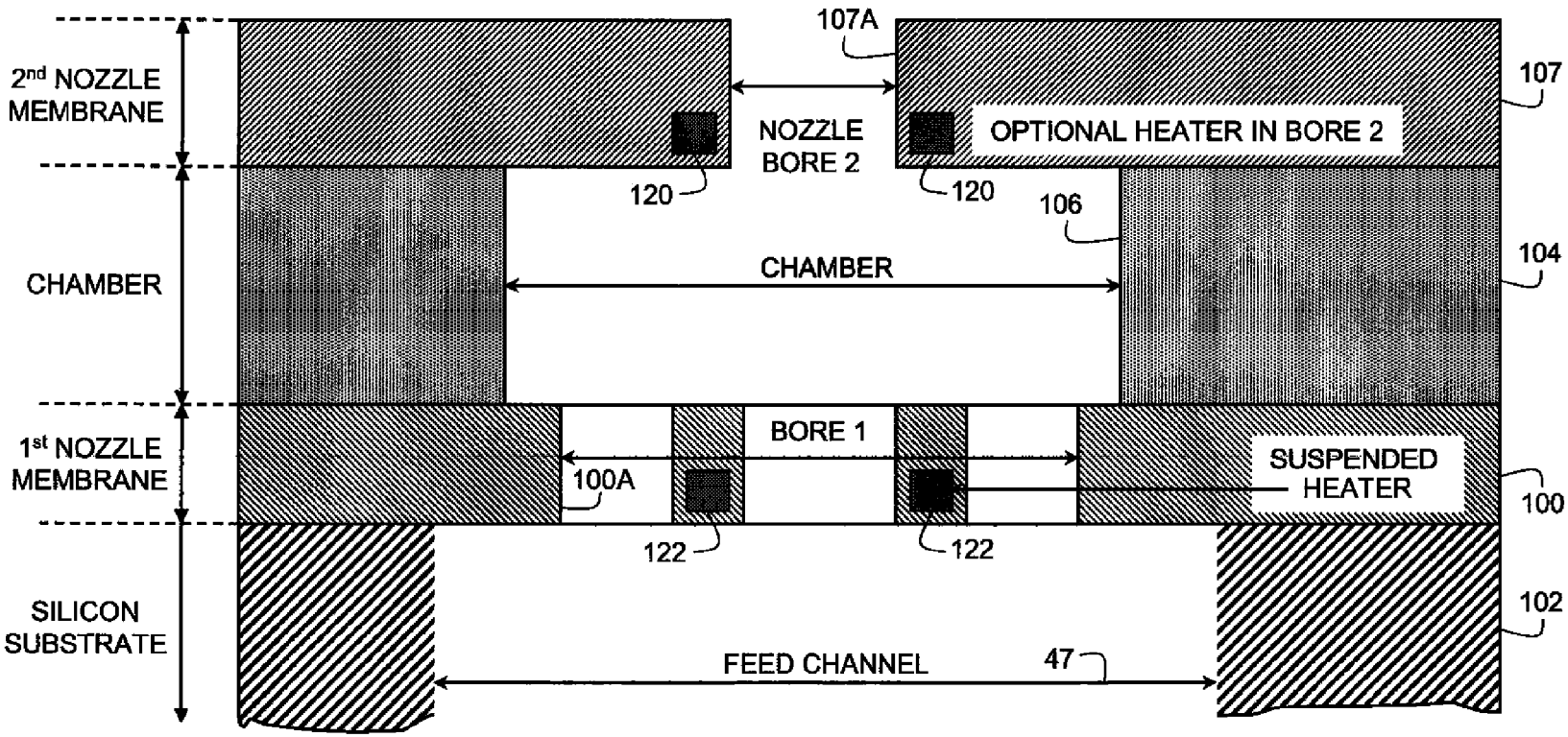
FIG. 6 is a schematic cross sectional view of another example embodiment of a printhead made in accordance with the present invention.
Figure 7:
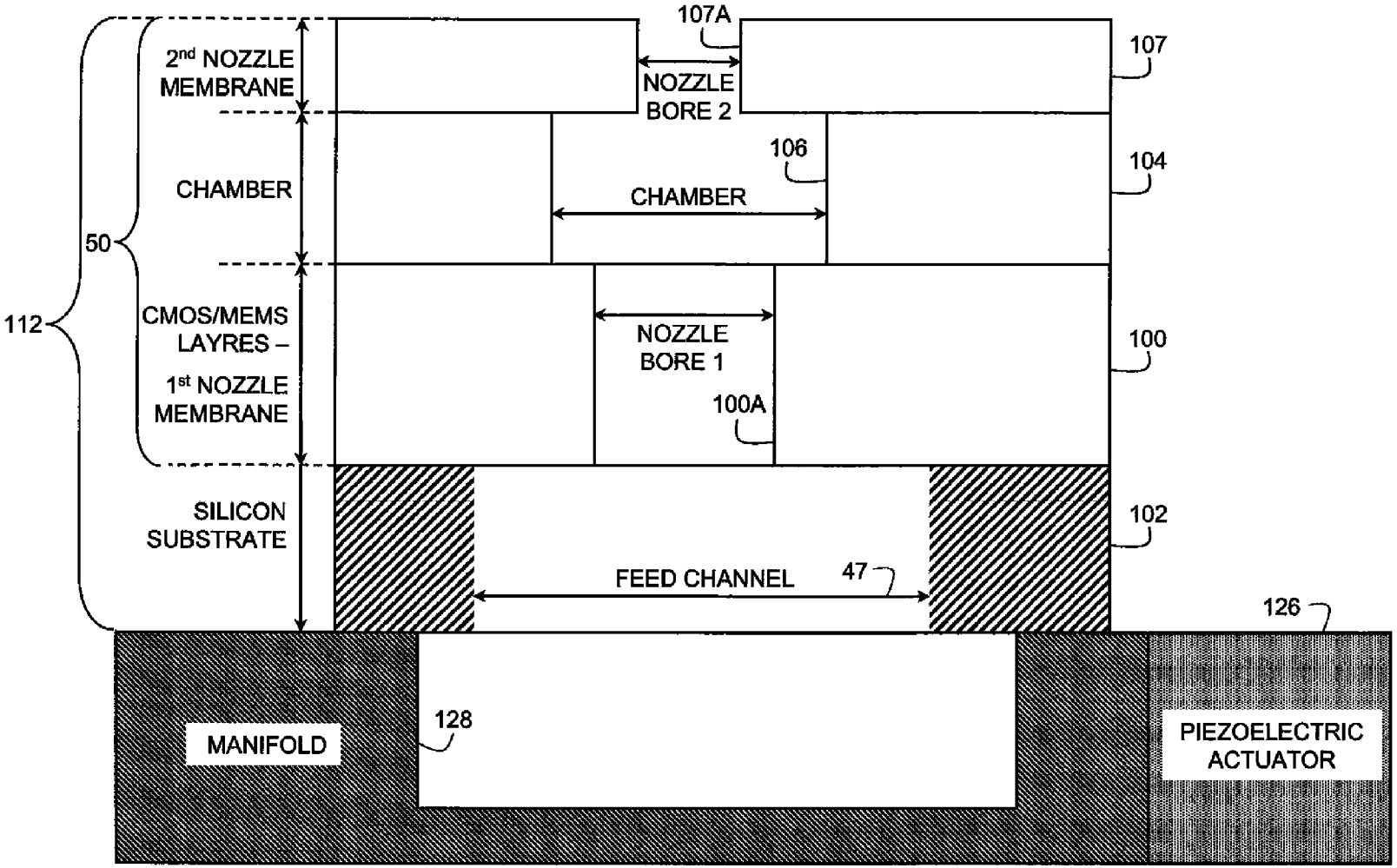
FIG. 7 is a schematic cross sectional view of another example embodiment of a printhead made in accordance with the present invention.

At this point, the silicon wafers are taken out of the CMOS facility. The support layer 104 is typically coated and patterned at this stage followed by deposition and patterning of layer 107 (as shown in FIG. 7) or layers 107 (as shown in FIGS. 4-6). Additionally, the silicon wafers are thinned from their initial thickness of 675 micrometers to about 300 micrometers. A mask to open ink channels is then applied to the backside of the wafers and the silicon is etched in a deep reactive ion etcher such as that available from STS, all the way to the front surface of the silicon. Alignment of the ink channel openings in the back of the wafer to the nozzle array in the front of the wafer can be provided with an aligner system such as the Karl Suss 1X aligner system.

Figure 9:
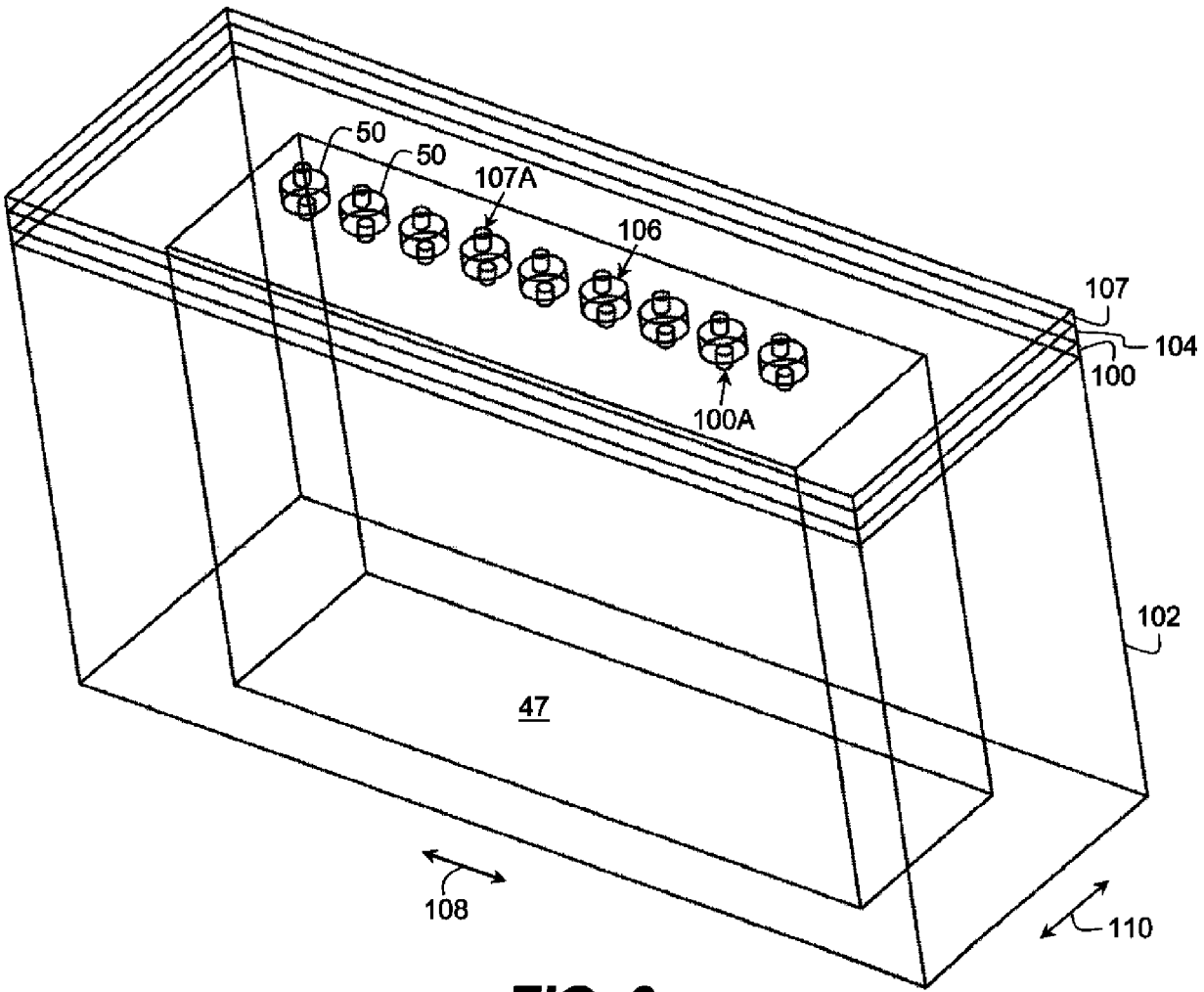
FIG. 9 is a schematic perspective view of another example embodiment of a printhead made in accordance with the present invention.
Figure 10:
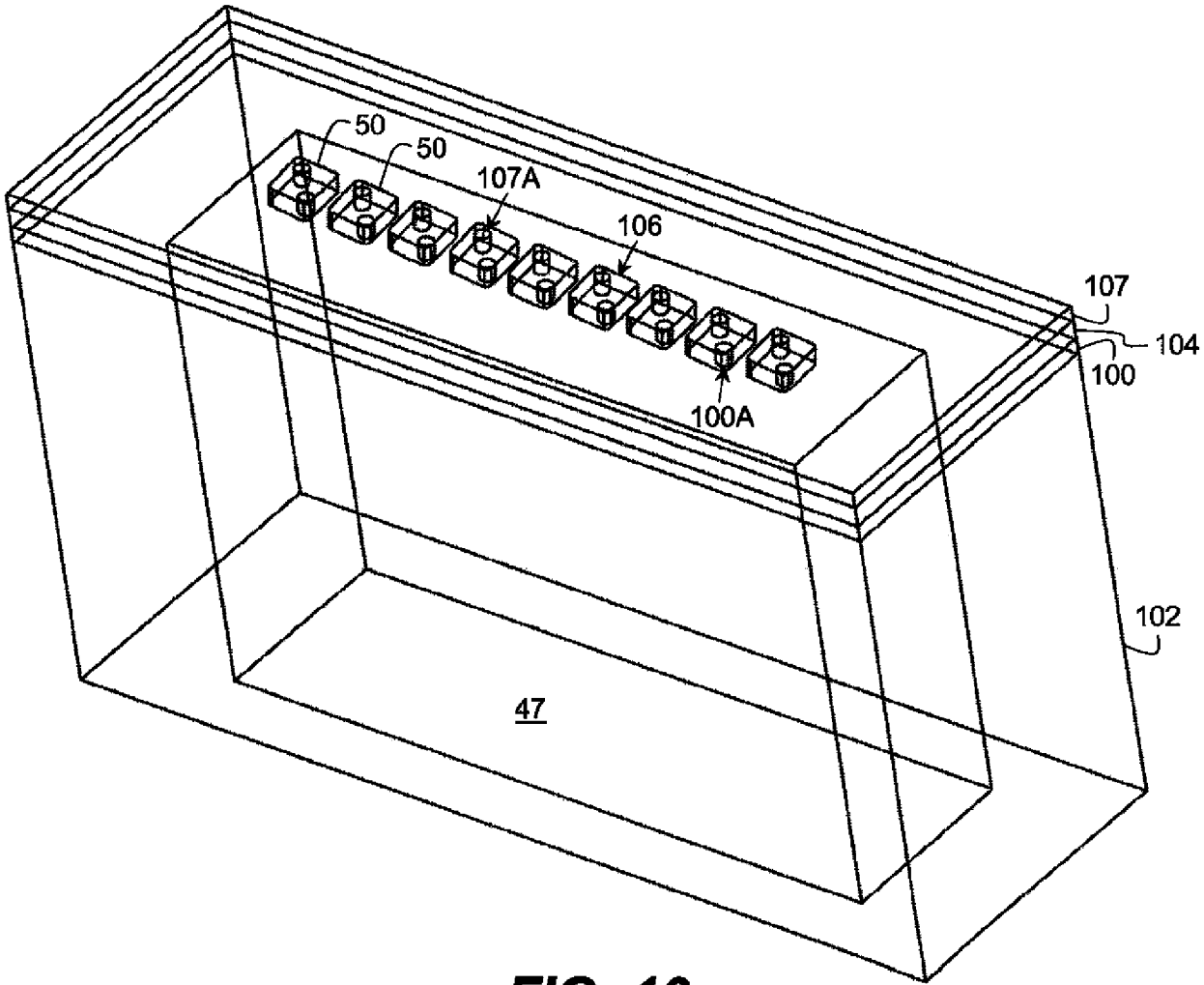
FIG. 10 is a schematic perspective view of another example embodiment of a printhead made in accordance with the present invention.

Referring to FIGS. 9 and 10, and back to FIGS. 4 and 5, printhead 30 includes length dimension 108 and width dimension 110. A plurality of nozzle structures 50 are located along the length 108 of jetting module 48 (and printhead 30). Liquid feed channel 47 formed in the silicon substrate is shown as being a rectangular cavity passing centrally beneath the nozzle structure 50 array. Traditionally, the combination of a long cavity liquid feed channel 47 in the center of the nozzle structure array and the thickness of the nozzle membrane 100 might structurally weaken the printhead 30 so that if the printhead 30 were subject to mechanical stresses, such as during packaging or operation, nozzle membrane 100 could crack. The presence of support structure 104, which is positioned between first nozzle membrane 100 and second nozzle membrane 107, provides structural support to nozzle structure 50 reducing the likelihood of nozzle membrane 100 failure. Inclusion of support structure 104 in printhead 30 also allows an internal surface 124 of first nozzle membrane 100 that is adjacent to liquid feed channel 47 and also helps to define channel 47 to be substantially planner which helps to create a common liquid feed channel 47 relative to nozzles 50. Support structure 104 is void of the stimulation devices and drive circuitry described above. In FIG. 4, second nozzle membrane 107 is also void of the stimulation devices and drive circuitry described above. In FIG. 5, however, second nozzle membrane 107 includes an additional drop forming mechanism 120, in this case, a heater. Drop forming mechanism 120 can be fabricated using the same processes described above. Alternatively, second nozzle membrane 107 can include other types of stimulation devices and the drive circuitry described above.

Referring to FIG. 6, another example embodiment of the present invention is shown. A drop forming mechanism 122 is operatively associated with the nozzle plate of the jetting module 48. In this embodiment, drop forming mechanism 122 is a heater positioned suspended in the opening of an annular first nozzle bore 100A. This design also facilitates a better heat transfer between the heater and fluid and a more effective jet break up and drop formation. Second nozzle membrane 107 also includes a drop forming mechanism 120 which is also a heater in this embodiment.

Referring to FIG. 7, another example embodiment of the present invention is shown. The drop forming mechanism 126 is a piezoelectric actuator affixed to a liquid manifold 128 of printhead 30. Liquid manifold 128 is in liquid communication with each nozzle structure and supplies liquid to each nozzle structure 50 through common liquid channel 47.

Figure 8A:
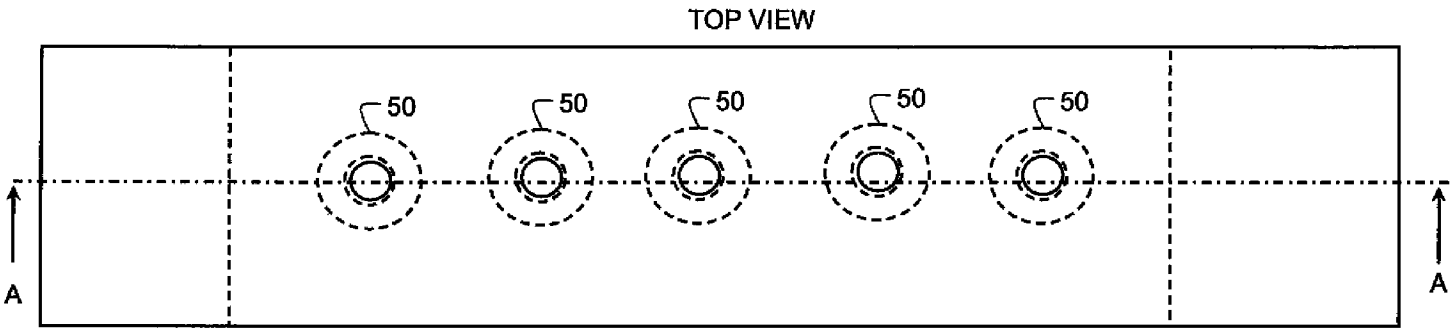
FIG. 8A is a schematic top view of another example embodiment of a printhead made in accordance with the present invention.
Figure 8B:
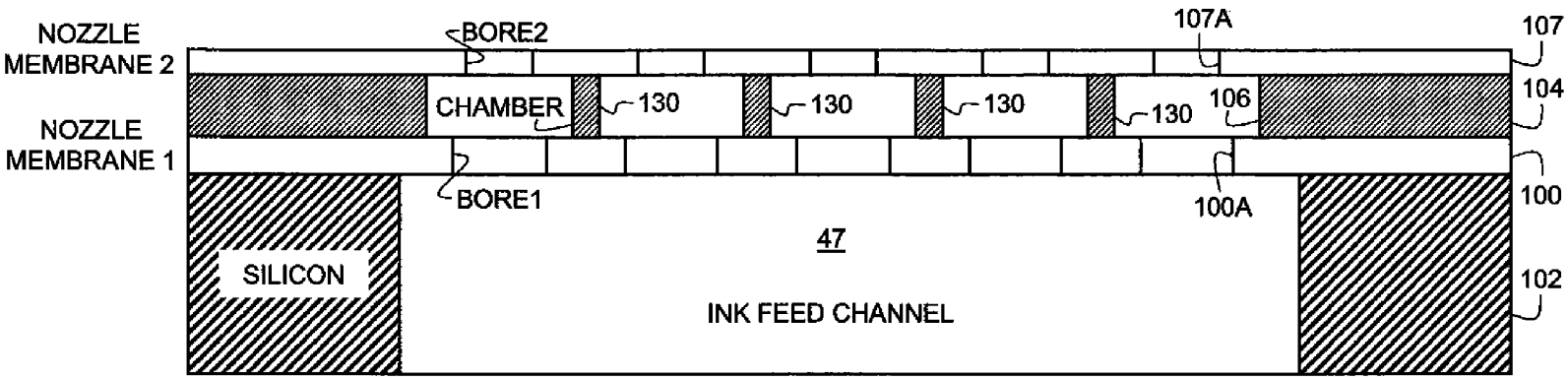
FIG. 8B is a schematic cross sectional view of the example embodiment shown in FIG. 8A taken along lines A-A.

Referring to FIGS. 8A and 8B, a jetting module 48 including a plurality of nozzle structures 50 is shown. A liquid channel 47 is in liquid communication with each of the plurality of nozzle structures 50 and is common to all of the nozzle structures 50. Liquid channel 47 includes no physical barriers between successive nozzle structures 50. As such, liquid is permitted to flow between successive nozzle structures 50. A wall 130 is positioned between successive nozzle structures 50 and physically separates one nozzle structure 50 from a neighboring nozzle structure 50. As described above, a drop forming mechanism, for example, a heater or a piezoelectric actuator, is operatively associated with the nozzle structures. When a heater is used as the drop forming mechanism, typically a heater is associated with one or both of the first nozzle bore 100A and the second nozzle bore 107A of each nozzle structure 50. When a piezoelectric actuator is used as the drop forming mechanism, the piezoelectric actuator can be associated with groups (a plurality) of nozzle structures 50. A liquid manifold, shown in FIG. 7, supplies liquid to common liquid feed channel 47. One advantage of the nozzle structure geometry 50 including an embedded heater drop forming mechanism, shown in FIGS. 4-6, is a reduction in cross-talk between plurality of nozzles, shown in FIG. 8B, because of the added fluidic impedance of nozzle structures 50 when compared to nozzle structures that don't include layers 104 and 107.

Referring back to FIGS. 9 and 10, liquid chamber 106 can have different shapes. For example, liquid chamber 106 can be circular (FIG. 9) or rectangular (FIG. 10). Alternatively, the shape of liquid chamber 106 can be elliptical or polygonal. The optimum shape of liquid chamber 106 typically depends on the ability of the support layer 104 to provide the required mechanical strength while helping to maintain the straightness of jet directionality.

Figure 11:
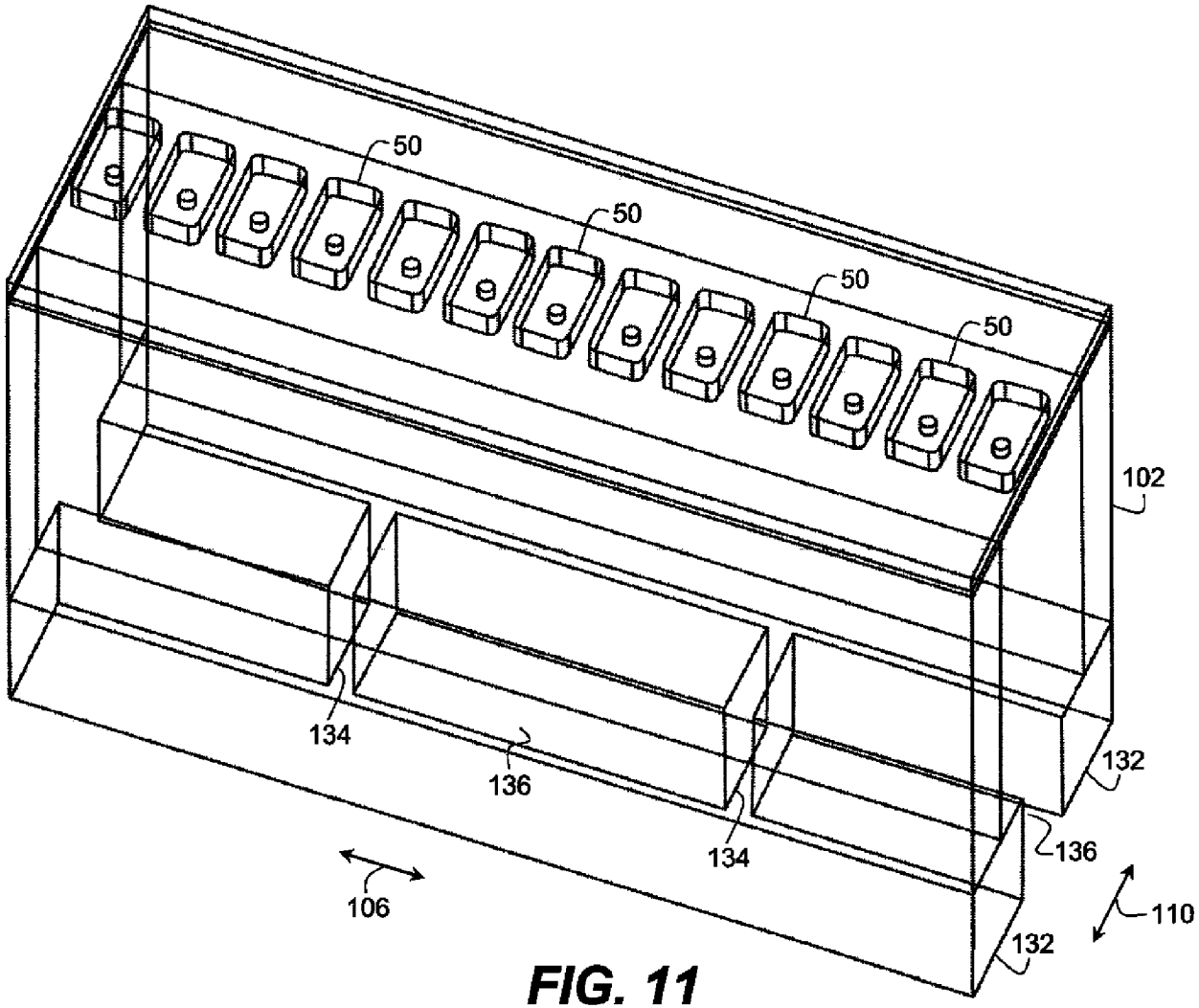
FIG. 11 is a schematic perspective view of another example embodiment of a printhead made in accordance with the present invention.

Referring to FIG. 11, a second substrate 132 is affixed to substrate 102. Second substrate 132 includes a rib or ribs 134 that span the width 110 of liquid feed channel 47. Second substrate 132 can be bonded to substrate 102 of the nozzle plate. Second substrate 132 can also be made of silicon and channels 136 can be etched intermediately to create ribs 134 for subsets of the plurality of nozzles. The ribs 134 of second substrate 132 help to provide additional structural robustness to the nozzle plate.

Figure 12A:
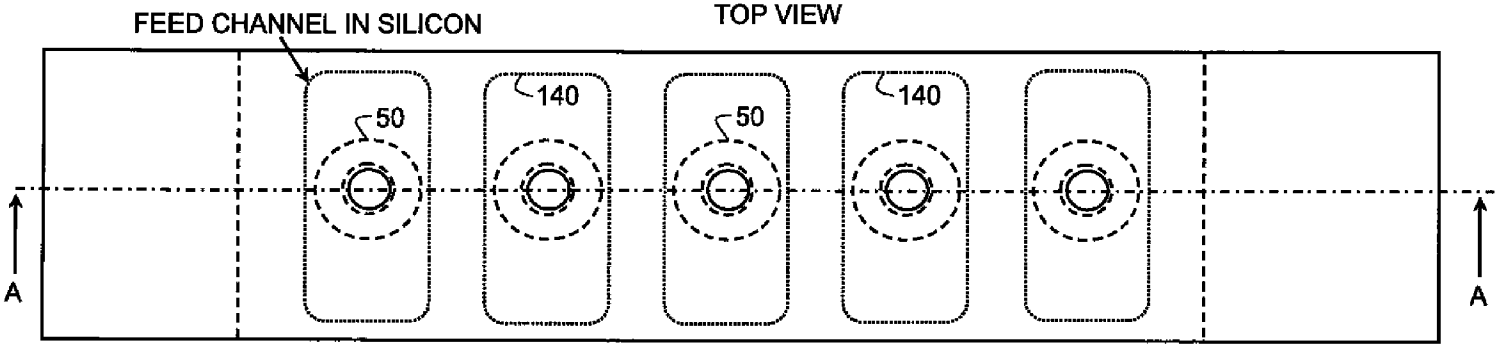
FIG. 12A is a schematic top view of another example embodiment of a printhead made in accordance with the present invention.
Figure 12B:
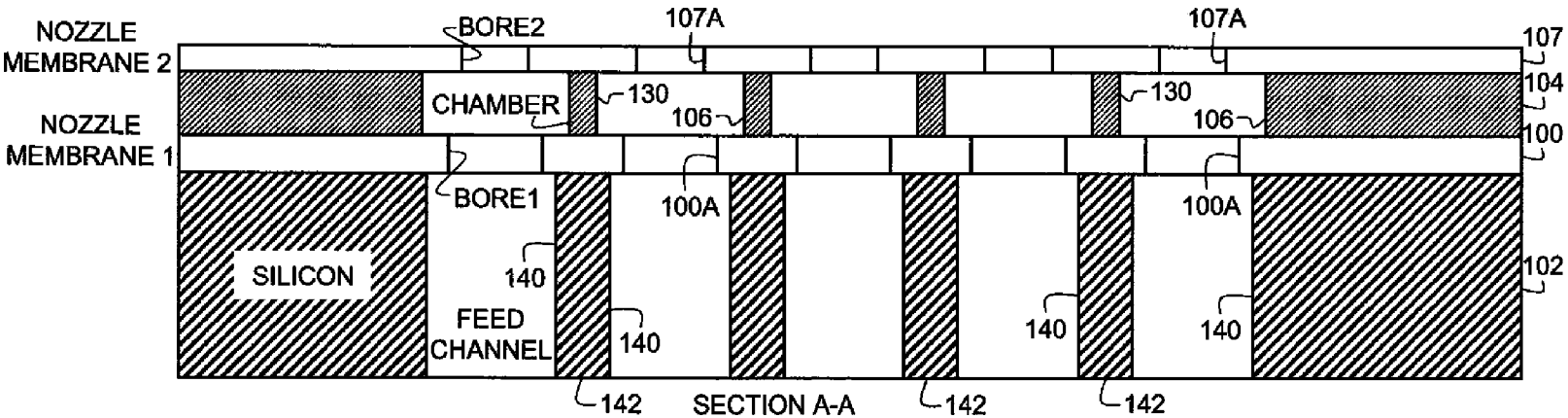
FIG. 12B is a schematic cross sectional view of the example embodiment shown in FIG. 8A taken along lines A-A.

Referring to FIGS. 12A and 12B, nozzle structure geometry 50 can also be used with a plurality of ink feed channels 140 that individually feed a corresponding one of the plurality of nozzle structures 50. Feed channels 140 can be formed into various shapes, for example, rectangular, circular, oval, or elliptical. This individual feed channel design that includes one or more ribs 142, fabricated from silicon, for example, provides additional structural support to the printhead while the nozzle geometry 50 provides advantages of custom materials (different from CMOS layers) and thickness of nozzle membrane 107 and nozzle bore geometry 107A for better jet directionality as well as drop formation (as described above). Additionally, an optimized bore geometry 100A and heater geometry 122 also mitigate undesirable cross-talk, if present, between the plurality of the nozzles.

The invention has been described in detail with particular reference to certain preferred embodiments thereof, but it will be understood that variations and modifications can be effected within the scope of the invention.

PARTS LIST

20 continuous printing system
22 image source
24 image processing unit
26 mechanism control circuits
28 device
30 printhead
32 recording medium
34 recording medium transport system
36 recording medium transport control system
38 micro-controller
40 ink reservoir
42 ink catcher
44 ink recycling unit
46 ink pressure regulator
47 ink channel
48 jetting module
49 nozzle plate
50 nozzle structures
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face

92 positive pressure source
94 negative pressure source
96 wall
100 first nozzle membrane
100A first nozzle bore
102 substrate
104 support structure
106 liquid chamber
107 second nozzle membrane
107A second nozzle bore
108 length dimension
110 width dimension
112 nozzle plate
114 portions
116 form walls
120 drop forming mechanism
122 drop forming mechanism
124 internal surface
126 mechanism
128 liquid manifold
130 wall
132 second substrate
134 ribs
136 channels
140 channels
142 ribs

The invention claimed is:

1. A printhead comprising:

a first nozzle bore defined by portions of a nozzle membrane;

a liquid chamber; and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber;

a first substrate affixed to the nozzle membrane, portions of the first substrate defining a liquid channel, the liquid channel including a width; and a second substrate affixed to the first substrate, portions of the second substrate including a rib that spans the width of the liquid feed channel.

2. The printhead of claim 1, further comprising:

a liquid manifold in liquid communication with the liquid chamber through the liquid channel.

3. The printhead of claim 1, the first nozzle bore, the liquid chamber, and the second nozzle bore being included in a jetting module, the printhead further comprising:

a drop forming mechanism operatively associated with the jetting module.

4. The printhead of claim 3, wherein the drop forming mechanism is a heater positioned in the opening of the first nozzle bore.

5. The printhead of claim 3, wherein the drop forming mechanism is a heater positioned adjacent to the opening of the second nozzle bore.

6. The printhead of claim 3, wherein the drop forming mechanism is a piezoelectric actuator.

7. The printhead of claim 1, wherein the opening of the first nozzle bore and the opening of the second nozzle bore are not equivalent.

8. A printhead comprising:

a jetting module including a plurality of nozzle structures, each nozzle structure including a first nozzle bore, a liquid chamber, and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber;

a liquid channel in liquid communication with the plurality of nozzle structures, the liquid channel including a width; and a rib that spans the width of the liquid feed channel.

9. The printhead of claim 8, wherein the liquid channel includes no physical barriers between successive nozzle structures so that liquid is permitted to flow between the successive nozzle structures.

10. The printhead of claim 8, further comprising:

a liquid manifold in liquid communication with the liquid channel.

11. The printhead of claim 8, wherein a wall separates successive liquid chambers of successive nozzle structures.

12. The printhead of claim 8, further comprising:

a drop forming mechanism operatively associated with the jetting module.

13. The printhead of claim 12, wherein the drop forming mechanism includes a heater is associated with one of the first and second nozzle bores of each nozzle structure.

14. The printhead of claim 12, wherein the drop forming mechanism includes a piezoelectric actuator is associated with a group of nozzle structures.

15. The printhead of claim 8, further comprising:

a plurality of liquid channels, each liquid channel being in liquid communication with a corresponding one of the plurality of nozzle structures.

16. A method of printing comprising:

providing a printhead including:

a jetting module including a plurality of nozzle structures, each nozzle structure including a first nozzle bore, a liquid chamber, and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber;

a liquid channel in liquid communication with the plurality of nozzle structures, the liquid channel including a width;

a rib that spans the width of the liquid feed channel; and a drop forming mechanism associated with the jetting module;

providing a liquid under pressure sufficient to eject jets of the liquid through the plurality of nozzle structures; and actuating the drop forming mechanism to form drops from the jets of liquid.

17. A printhead comprising:

a jetting module including a plurality of nozzle structures, each nozzle structure including a first nozzle bore, a liquid chamber, and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber;

a drop forming mechanism including a heater that is associated with one of the first and second nozzle bores of each nozzle structure; and a source of liquid that provides to the jetting module liquid under pressure sufficient to eject jets of the liquid through the plurality of nozzle structures.

18. A method of printing comprising:

providing a printhead including:

a jetting module including a plurality of nozzle structures, each nozzle structure including a first nozzle bore, a liquid chamber, and a second nozzle bore, the liquid chamber being positioned between the first nozzle bore and the second nozzle bore, the liquid chamber extending beyond the opening of the first nozzle bore, the first nozzle bore being in liquid communication with the second nozzle bore through the liquid chamber; and a drop forming mechanism including a heater that is associated with one of the first and second nozzle bores of each nozzle structure;

providing a liquid under pressure sufficient to eject jets of the liquid through the plurality of nozzle structures; and actuating the drop forming mechanism to form drops from the jets of liquid.

* * * * *